United States Patent [19]

Taylor et al.

[11] Patent Number: 4,685,221

[45] Date of Patent: Aug. 11, 1987

[54] STEAM-SHOWER APPARATUS AND METHOD OF USING SAME

[75] Inventors: Bruce F. Taylor, Auburn, Mass.; Kenneth G. Hagen, Cape Elizabeth, Me.

[73] Assignee: Thermo Electron - Web Systems, Inc., Auburn, Mass.

[21] Appl. No.: 834,957

[22] Filed: Feb. 28, 1986

[51] Int. Cl.[4] ..... F26B 13/02

[52] U.S. Cl. ..... 34/155; 34/160; 239/DIG. 7; 162/207

[58] Field of Search ..... 34/155, 160, 156, 54; 162/207, 359, 290; 239/DIG. 7

[56] References Cited

U.S. PATENT DOCUMENTS

| | | | |
|---|---|---|---|
| 3,574,338 | 4/1971 | Shelor | 239/553.3 |
| 3,945,570 | 3/1976 | Dove | 239/135 |
| 4,050,630 | 9/1977 | Dupasquier | 239/121 |
| 4,163,688 | 8/1979 | Kankaanpaa | 162/359 |
| 4,207,143 | 6/1980 | Glomb et al. | 162/207 |
| 4,253,247 | 3/1981 | Bergstrom | 34/155 |
| 4,271,602 | 6/1981 | Grolms | 34/160 |
| 4,580,355 | 4/1986 | Boissevain | 34/155 |

*Primary Examiner*—Larry I. Schwartz

*Attorney, Agent, or Firm*—Pahl, Lorusso & Loud

[57] ABSTRACT

Disclosed is a steam-shower apparatus and method including a supply of steam which is fed through a Coanda nozzle and along a path running parallel with one surface of the apparatus. The sheet to which the steam is to be applied runs parallel to this same surface of the machine, but in a direction opposite to the direction of the flow of steam. The sheet travels along a path spaced slightly from the surface of the machine, and the flow of steam runs the entire length of this surface heating the sheet as it flows in the opposite direction. The apparatus may be divided into several sections so that the sheet may be profiled along certain regions which are defined by these sections. In addition, means are included for altering the volume of flow to any one of the particular sections.

18 Claims, 4 Drawing Figures

STEAM-SHOWER APPARATUS AND METHOD OF USING SAME

BACKGROUND OF THE INVENTION

This invention relates to papermaking and more particularly to an apparatus for controlling the temperature of the sheet through the controlled application of steam against the sheet surface.

In the mechanical pressing of paper the drainage rate is proportional to the viscosity and surface tension of the trapped water. The increasing of sheet temperature decreases the water viscosity and surface tension, hence augmenting the pressing process. As shown in U.S. Pat. Nos. 3,574,338; 3,945,570; 4,050,630 and 4,163,688, it is common practice to apply steam to a sheet immediately prior to the sheet entering the press so that the latent heat of the steam heats the sheet.

The press is located before the dryer section of a paper-machine. Therefore, increasing the water removal rate through the press serves to decrease the sheet moisture content of a sheet entering the dryer-section, thereby either reducing the energy consumption required to further dry the sheet or increasing production (speed) at constant dryer section energy consumption.

The controlled application of steam at equally spaced increments across the machine can be employed to control the initial and hence final moisture profile of the sheet. At the dry end of the machine, following the dryer-section, the sheet is passed through a vertical column of horizontal-axis rolls known as a calender-stack. The surface finish and thickness or caliper of the sheet is directly affected by both the contact pressure between two adjacent rolls of the stack through which the sheet passes and the compressibility and shear modulus of the sheet, which are proportional to the moisture and temperature profile of the sheet (although not exclusively). Applying steam to the sheet using "steam-showers" will affect both the moisture and temperature of the sheet, and hence, the caliper and surface finish qualities (such as gloss) of the sheet. Applying a uniform amount of steam across the machine can thus decrease the caliper of the sheet leaving the calender stack and increase the gloss of the final product. Applying controlled amounts of steam at selected positions across the machine can thus be used, by extension, to control the caliper and/or gloss profile of the final product.

In any steam application, the effective usage of the consumed steam should be maximized. To maximize the effective usage, the percentage of consumed steam that condenses on the sheet for the purpose of raising the sheet temperature should be maximized, and the percentage of consumed steam that does not condense which exhausts to the atmosphere as wasted energy should be minimized.

There are certain applications where the steam application does not have to be positionally and volumetrically controlled. In other applications, however, it is necessary to impart steam to the process in controlled amounts at specified positions across the machine for profiling certain sheet qualities. This controlled imparting of steam is commonly performed as part of a closed-loop control system, where the sheet quality variable in question is scanned on-line at equally spaced increments across the machine, and the results obtained by the scanning device, through the use of computer analysis, are used to automatically control the steam-flow applied to the sheet in accordance with the desired sheet quality criteria.

The ability of known steam-shower apparatus to repeatedly apply a uniform steam flow is presently limited to the accuracy and repeatability of pneumatically actuated control valves, whose pneumatic-supply signal must first be converted from a computer level electric signal to a pneumatic counterpart using a current to pressure transducer, the combined accuracy and repeatability of which is questionable.

For the same reasons that it is important to control accurately the steam-flow to the application, it is also important to maintain uniform heat-transfer, over the portion of the sheet in question.

It is therefore a principal object of the present invention to provide a steam-shower apparatus which maximizes the percentage of consumed steam that condenses on the sheet.

Another object of the present invention is to provide a steam-shower apparatus which applies steam in such a way that the entrainment of non-condensable air into the condensation space, which severely hampers condensation heat transfer, is limited or eliminated.

It is another object of the present invention to provide a steam-shower apparatus which insures that the high initial relative velocities between the steam and the sheet, as required to provide effective heat transfer, are maintained over the full machine-direction length of the application apparatus.

Still another object of the present invention is to provide a steam-shower apparatus which insures that the steam-flow is made to travel over the full length of the steam application apparatus so that the time of contact between each volumetric unit of steam and the sheet is maximized.

Yet another object of the present invention is to provide a steam-shower apparatus that accurately and repeatably applies steam to a sheet at any required position across the machine.

Another object of the present invention is to provide a steam-shower apparatus that allows for improved accuracy and repeatability of steam-flow control.

Still another object of the present invention is to provide a steam-shower apparatus that applies steam to a sheet in such a way that uniformity of heat-transfer is provided in the cross-machine direction.

A further object of the present invention is to provide a steam-shower apparatus that applies the steam in such a way that the steam does not impinge on the sheet directly.

SUMMARY OF THE INVENTION

According to the present invention, a steam-shower apparatus is provided for use in controlling the temperature of a sheet by applying steam against the surface of the sheet. The apparatus includes a steam supply manifold which supplies steam through a feed pipe to a chamber leading to a Coanda nozzle. The Coanda nozzle is arranged in the apparatus so that the steam flowing through the Coanda nozzle is directed along a surface of the apparatus which is positioned adjacent and parallel to the sheet which is to be heated. The steam flows in a direction opposite to the direction of travel of the sheet so that a high relative velocity vector for the steam flow is achieved over the full distance of the steam-to-sheet contact. The apparatus includes a secondary chamber for receiving a sacrificial flow of steam which is entrained by the flow of steam exiting the Coanda nozzle.

In a preferred embodiment, the Coanda chamber and corresponding Coanda nozzle is divided into several Coanda chambers and associated nozzles by positioning baffles around several feed pipes which are arranged across the width of the machine. Each of the feed pipes is connected to a stepper motor which is coupled to a valve poppet which opens and closes an orifice in the feed pipe to either totally close the orifice to prevent steam from entering the feedpipe or to partially close the orifice to thereby adjust the volume of steam entering the feedpipe. This orifice control device allows for application of steam to be used in profiling operations.

These and other features and objects of the present invention will be more fully understood from the following detailed description in which corresponding reference numerals represent corresponding parts throughout the several views.

DETAILED DESCRIPTION OF THE PREFERRED EMBODIMENTS

Figure 1:
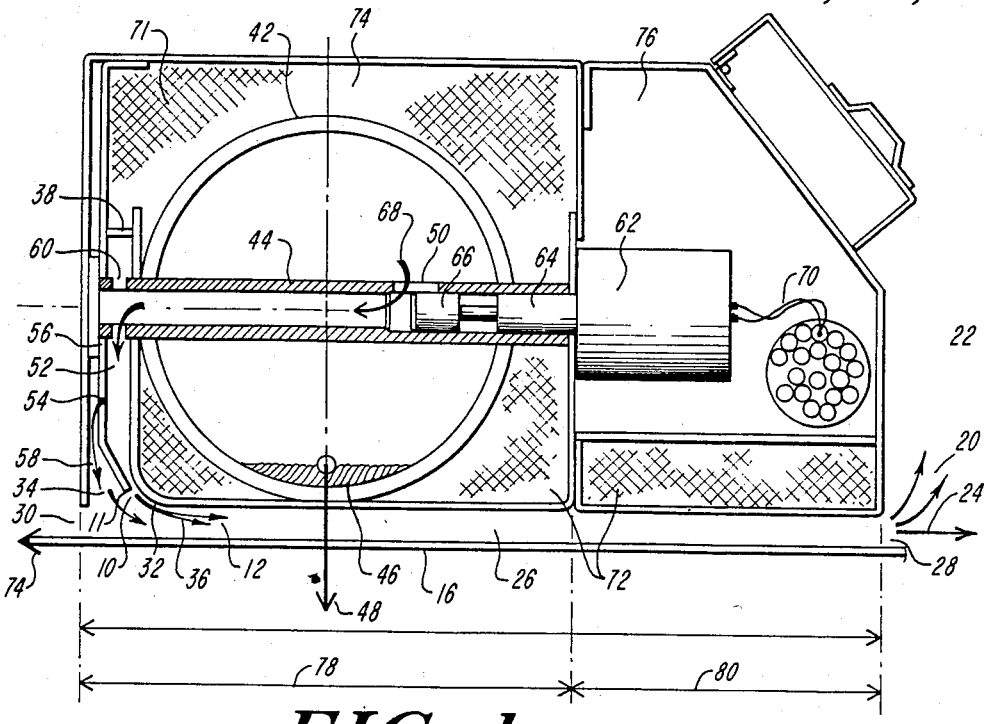
FIG. 1 is a sectional-view of a steam-shower apparatus of the present invention, positioned adjacent to the sheet, employing positional steam-flow control.

Referring to FIG. 1, the steam-shower apparatus for applying steam to a sheet, hereafter referred to as a "steam-foil", includes an air-foil type nozzle 10, utilizing the Coanda effect, to impart steam in a direction 12 roughly parallel but opposite in direction to the direction 14 of travel of the sheet 16. This Coanda effect steam foil prevents the direct impingement of steam on the sheet, so that the steam-foil may be installed directly above or below an unsupported sheet 16 without inflicting mechanical damage to the sheet. In addition, water droplets in the steam are conveyed parallel to the sheet for a distance greater than the distance water droplets are conveyed with an impingement-type steam shower, thereby aiding in the process of droplet dispersion and re-vaporization. Such droplet dispersion and re-vaporization is useful in minimizing "spotting" of the sheet. Unlike an impingement-type steam shower where the flow vector stagnates against the sheet, or a "lazy-steam" hood applicator where the relative velocity vector important for heat-transfer is not maintained, the parallel counter-flow principal of the invention insures the continuance of a high relative velocity vector over the full distance 18 of steam-to-sheet contact.

By locating the Coanda nozzle exit slot 11 at the downstream edge of the steam-foil, steam is forced to travel over the full length 18 (machine-direction) of the steam-foil before non-condensed steam 20 may exhaust to the atmosphere 22. In comparison in known impingement-type steam showers which impart steam to the sheet through either a full-coverage array of holes or slots or a raised hood into which steam is supplied for full-coverage application, only that steam applied at the upstream edge is exposed to the sheet for the full duration of the sheet-travel under the apparatus (as the moving sheet typically carries the upstream steam with it for exhausting at the downstream edge). The duration of steam contact with a sheet for other steam-shower units is proportionately decreased by the distance of the point of application from the upstream edge (the extreme case being those units of steam applied close to the downstream edge whose duration of contact with the sheet is negligible).

An additional feature of the invention is that the high velocity counter-flow running parallel to the sheet insures that even after exhausting at the upstream edge, a significant percentage of the non-condensed steam 24 continues to flow roughly parallel to the sheet for a considerable distance, effectively preheating the sheet before it actually enters the apparatus. This non-condensed steam 24 thereby serves to effectively utilize some of the exhaust steam which would otherwise be wasted.

In the interest of limiting the entrainment of non-condensible air into the condensing-space 26 located between the apparatus and the sheet 16, the counter parallel-flow nature of the system insures that the exhausting steam creates a positive pressure "wall" at the incoming or upstream edge 28 of the apparatus, thereby decreasing the volume of air which can be entrained by the moving sheet 16. At the outgoing or downstream edge 30 of the apparatus, the velocity of the sheet serves to limit the volume of air entering the condensing space, close to the surface of the exiting sheet. Typically, a Coanda nozzle 1 will entrain, from its ambient surroundings, a volume of fluid (on a mass basis) required to offset the angular momentum or centripetal forces created by the curved path of travel of the nozzle fluids around the Coanda nozzle surface 32. To limit or eliminate this entrainment from close to, and behind the Coanda nozzle, a sacrificial flow of steam 34 (approximately 10 to 30% of the nozzle flow) is supplied at low velocity normal to the sheet 16, behind the nozzle 10. The sacrificial steam-flow 34 is intended to be entrained by the nozzle flow 36, rather than air outside the apparatus, which would be detrimental to the heat-transfer performance of the apparatus.

Figure 2:
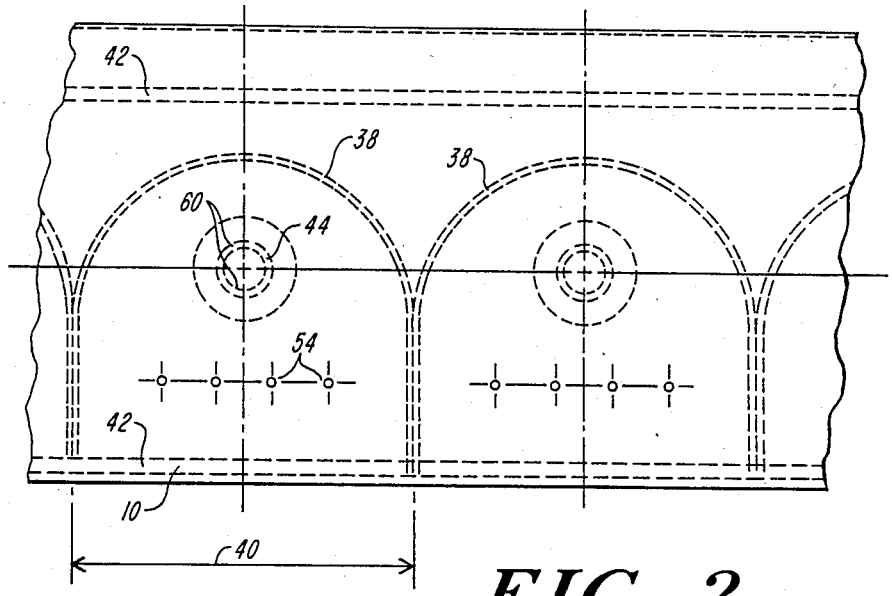
FIG. 2 is a front elevational view of a segment of the steam-shower apparatus shown in FIG. 1.

Referring now to FIG. 2 as well as FIG. 1, the design of the Coanda nozzle 10 and the internal baffling required on a unit employed for the variable control of positional and volumetric steam-flow, hereafter referred to as the profiling embodiment of the invention, is such that steam exits the nozzle to be used in the process described above through a uniform slot 11, thereby insuring uniformity of steam-flow and heat-transfer in the cross-machine direction at the desired positional location 40.

Steam is supplied to the apparatus and conveyed across the machine width by an oversized distribution header 42 (typically having a six inch diameter) to insure uniform supply distribution across the machine. At equal spacings across the machine, feed-pipes 44 (typically having a one inch diameter) located horizontally and normal to the axis of the supply manifold 42 traverse the diameter of the supply manifold 42.

Any undesirable condensation in the supply manifold 42, being heavier than vapor, collects in the bottom 46 of the manifold 42 where it is bled to drain at the rear 48 of the apparatus. The removal of condensation from the manifold 42 insures that condensation in the nozzle exit-flow 14 is minimized.

An orifice 50 in the side of each feed-pipe 44 allows the steam to enter into the feed-pipe 44 from the supply manifold 42. The feed-pipe conveys the steam through two feed-pipe end-orifices 60 to a Coanda nozzle chamber 52. The steam exits the chamber 52 through the Coanda nozzle slot 11 from which it is applied to the sheet 16. Bleed holes 54 of a suitable diameter and spacing are located in the outboard wall 56 of the Coanda nozzle chamber 52. The specific diameter and spacing of the bleed holes 54 are chosen to provide the desired percentage of steam 34 to flow to a "sacrificial" steam chamber 58 to provide the sacrificial steam flow 34.

In the profiling embodiment of the invention, a direct-current stepping motor 62 is mounted on the outboard end of the feed-pipe 44. A lead-screw type coupling 64 connects the stepping motor shaft to a translating valve-poppet 66 located in the body of the feed-pipe 44 in the region of the inlet orifice 21.

Positioning of the stepping motor shaft angle translates the valve poppet 66 so as to increase or decrease the available open-area of the feed-pipe inlet orifice 50. As a result, the flow-rate of steam 68 through the feed-pipe inlet orifice 50 may be controlled, thereby enabling the controlled application of steam to the sheet.

The choice of a stepping-motor 62 as the preferred type of valve actuator is particularly important to the accuracy and repeatability of the control process. The small angular increments of shaft position (typically 2 degrees per step), combined with the turn-down ratio of the lead-screw coupling 64 combine to provide approximately 5000 precise and repeatable available valve-poppet 66 positions over a total valve-poppet travel of one inch. The specific values cited above may be changed in accordance with specific design requirements, but this example serves to indicate the extraordinary control definition, accuracy and repeatability available with such an actuator.

In addition to the above stated features, an attractive aspect of the stepping-motor actuator 62 is that it may be electrically coupled through actuating lines 70, directly to a computer control system so often used in profiling applications. Such coupling eliminates the need for any intermediate signal conversion (i.e. from electric to pneumatic), with an attendant presummed improvement in both control accuracy and repeatability.

The stepping-motor actuator 62, of course, may be replaced by any type of actuator which will operate a poppet-like device to provide the desired steam-flow control. In one embodiment, the stepping-motor actuator 62 is replaced by a manual valve comprising a threaded shaft which translates the valve-poppet 66, through the use of a fixed matching-threaded bushing in the region of the previously indicated lead-screw coupling 64. The outboard end of the threaded shaft includes, in the region of the previously indicated stepping-motor 62, a gripping-handle of suitable design to allow an operator to manually translate the valve-poppet 66 as required to manually vary the nozzle steam-flow 68.

To insure that steam originating from any specific control valve 50 is applied only to that portion 40 of the sheet that is colinear with the valve 50 and intended to be controlled, the Coanda chamber 52 is sectionally baffled with semi-circular baffles 38. The baffles 38 eliminate carry-over to adjacent nozzle locations. The "sacrificial" steam chamber 25 need not be baffled as it is reasoned that the low velocity of the "sacrificial" steam-flow 34, and the entrainment tendancy exhibited by the Coanda nozzle 10 will combine to insure that the "sacrificial" flow 34 is applied for use by the apparatus in the region 40 for which the application is intended.

The main body of the apparatus is insulated about the supply-manifold 42 with suitable insulation 72 to minimize the likelihood of condensation carry-over and to maximize the usage of the steam latent heat for the purpose intended.

As shown in FIG. 1, the apparatus includes two separate structural chambers, the manifold/nozzle chamber 74 (which in the preferred embodiment is of fixed standardized length 78) and the controls chamber 76 (which in the preferred embodiment is of variable length 80). The variable length 36 may be chosen so as to provide the required apparatus length 18 required to aid in the attainment of the necessary steam condensing rate for each specific application. Alternatively, both lengths 78 and 80 may be chosen as fixed values, so as to provide a fixed apparatus length 18 deemed to be satisfactory for the attainment of successful performance over the full range of expected applications.

Figure 3:
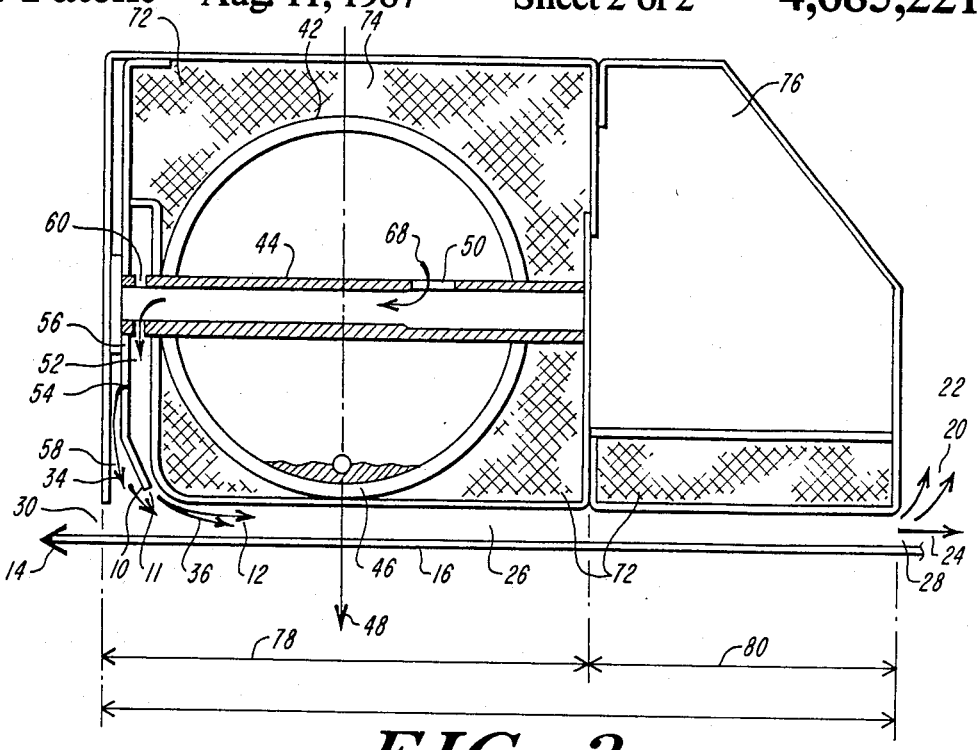
FIG. 3 is a sectional view of an alternate embodiment steam-shower apparatus shown in FIG. 1, positioned adjacent the sheet, employing a uniform cross-machine steam-flow.

Referring to FIG. 3, an alternate embodiment of the present invention is shown in which the apparatus is not segmented, and a uniform application of steam across the full width of the sheet is provided. In view of the fact that the profiling operations described above with respect to the FIG. 1 embodiment are not necessary, the apparatus of FIG. 3 does not include the stepping motors 62, valve-poppets 66, and the Coanda nozzel baffles 38. The remaining components of the apparatus are identical to the apparatus shown in FIG. 1, and operation is identical to operation of the FIG. 1 embodiment with each orifice 50 of the apparatus completely open.

The foregoing invention has been described with reference to its preferred embodiments. Various alterations and modifications will, however, occur to those skilled in the art. For example, the "sacrificial" steam-flow chamber 58, could be deleted if it is not necessary for the adequate heat-transfer performance of the apparatus in a given application. The "sacrificial" steam-flow chamber 58 could also be sectionally baffled in the profiling embodiment of the invention, in a manner previously described for the Coanda nozzle chamber 22 if it is necessary to insure that the "sacrificial" flow 13 is applied to the process in the region 16 for which the application is intended.

The "steam-shower" apparatus could be constructed of a reduced cross-machine length, in either of the FIG. 1 and FIG. 3 embodiments, to provide an apparatus whose function is to operate over only a reduced percentage of the actual paper-machine width.

Figure 4:
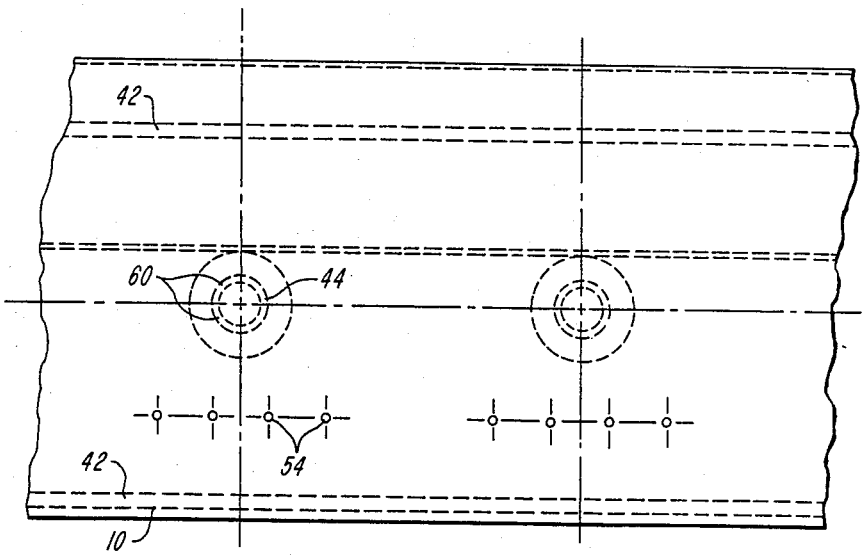
FIG. 4 is a front elevational view of a segment of the steam-shower apparatus shown in FIG. 3.

The "profiling" embodiment of FIGS. 1 and 2, and the "non-profiling" embodiment of FIGS. 3 and 4, could be installed in series or physically coupled in series, in the machine direction, in such a way as to provide a design iteration which would provide one shower segment for the purpose of uniform cross-direction steam application, and one shower segment for the purpose of profiling steam application on a positional and volumetric basis. Typically, such an embodiment of the invention would be used to provide both a machine production increase and an independent moisture profiling function, although other applications and purposes are possible, in view of the various uses for steam-showers on a paper-machine.

These and other alterations and modifications are intended to fall within the scope of the appended claims.

What is claimed is:

1. An apparatus for applying a flow of steam to a sheet for the purpose of heating the sheet which runs parallel to a surface of the apparatus adjacent the sheet, the apparatus comprising:

means for creatin a supply of steam;

a Coanda nozzle positioned within the apparatus to receive a supply of steam and to cause the steam to flow parallel both to the adjacent surface of said apparatus and to said sheet, said flow of steam travelling in a direction opposite to the direction of travel of the sheet;

means for provide steam from said supply to said Coanda nozzle;

means for delivering a secondary supply of steam to a location downstream from said Coanda nozzle so that said secondary flow of steam is entrained by the supply of steam flowing from said Coanda nozzle thereby preventing entrainment of any fluid from the atmosphere external to the apparatus.

2. The apparatus for applying a flow of steam to a sheet of claim 1 further comprising:

means to control the flow of steam so that steam contact with the sheet is limited to a selected region across the width of the sheet.

3. The apparatus for applying a flow of steam to a sheet of claim 2 wherein said control means comprises:

means for dividing said Coanda nozzle into at least two Coanda nozzles, each of said at least two nozzles including a chamber through which steam passes;

means for providing a flow of steam to each of said at least two Coanda nozzles.

4. The apparatus for applying a flow of steam to a sheet of claim 3 wherein said means for dividing said Coanda nozzle into at least two Coanda nozzles comprises:

semi-circular baffles positioned across the width of the apparatus to surround said means for providing a flow of steam to each of said at least two Coanda nozzles, said baffles preventing carry over of steam from one chamber to any other chamber.

5. The apparatus for applying a flow of steam to a sheet of claim 1 wherein said means to provide steam comprises:

a feed pipe having an orifice communicating with said means for creating a supply of steam, said steam entering said feed pipe through said orifice, said feed pipe also including a second orifice for providing said steam to said Coanda nozzle.

6. The apparatus for applying a flow of steam to a sheet of claim 5 wherein said means to provide steam further comprises:

a selectively actuable stepper motor;

means for adjustably controlling the percentage of said orifice which is open to said supply of steam, said orifice adjustable control means completely closing said orifice to prevent the flow of steam through one of said at least two Coanda nozzles and partially closing said orifice to adjust the volume of steam flowing through one of said at least two Coanda nozzles;

coupling means for connecting said stepper motor to said means for adjustably controlling said orifice.

7. The apparatus for applying a flow of steam to a sheet of claim 6 wherein said means for adjustably controlling the percentage of said orifice which is open to said supply of steam is a valve-poppet and the coupling means is a lead-screw coupling connected to a shaft of said stepper motor.

8. The apparatus for applying a flow of steam to a sheet of claim 1 further comprising:

a housing surrounding said means for creating a supply of steam;

insulation positioned within said housing and surrounding said means for creating a supply of steam, said insulation minimizing the likelihood of condensation carryover and maximizing the usage of steam latent heat to heat the sheet.

9. The apparatus for applying a flow of steam to a sheet of claim 8 wherein said housing has a fixed length, and further comprising:

a second housing for housing said stepper motor, said second housing being connectable to said first housing at an upstream edge of said first housing and being of a length sufficient, when added to the length of said first housing, to provide the desired length of contact between the steam and the sheet.

10. The apparatus for applying a flow of steam to a sheet of claim 1 further comprising a means for creating a positive pressure wall at the edge of said apparatus where the sheet first comes into a position adjacent said apparatus.

11. The apparatus for applying a flow of steam to a sheet of claim 1 further comprising means for draining condensation from said means for creating a supply of steam.

12. The apparatus for applying a flow of steam to a sheet of claim 1 further comprising insulation surrounding said means for creating a supply of steam.

13. An apparatus for applying a flow of steam to a sheet for the pupose of heating the sheet which runs parallel to a surface of the apparatus adjacent the sheet, the apparatus comprising:

means for creating a supply of steam;

a Coanda nozzle positioned within the apparatus to direct a flow of steasm to run parallel both to the adjacent surface of said apparatus and to said sheet, said flow of steam travelling in a direction opposite to the direction of travel of the sheet;

a feed pipe having an orifice communicating with said means for creating a supply of steam, said steam entering said feed pipe through said orifice, said feed pipe also including a second orifice for providing steam to said Coanda nozzle;

means for creating a secondary flow of steam from said feed pipe, said secondary flow of steam being supplied at a location relative to said Coanda nozzle so that said secondary flow is entrained by teh steam emitted from said Coanda nozzle.

14. An apparatus for applying a flow of steam to a sheet for the purpose of heating the sheet which runs parallel to a surface of the apparatus adjacent the sheet, the apparatus comprising:

means for creating a supplying of steam;

a Coanda nozzle positioned within the apparatus to cause a flow of steam to run parallel both to the adjacent surface of said apparatus and to said sheet, said flow of steam travelling in a direction opposite to the direction of travel of the sheet, said Coanda nozzle being divded into at least two Coanda nozzles, each of said at least two nozzles including a chamber through which steam passes;

means for providing a flow of steam to each of said at least two COanda nozzles;

means for creating a secondary flow of steam from said steam supply, said secondary flow of steam being supplied at a location relative to each of said at least two Coanda nozzles so that asid secondary flow is entrained by the steam emitted from each of said at least two Coanda nozzles, said secondary flow of steam providing a second source of steam thereby preventing entrainment of air from the atmosphere external to the apparatus.

15. The apparatus for applying a flow of steam to a sheet of claim 14 wherein said means to provide a flow of steam comprises:

a feed pipe associated with each of said at least two Coanda nozzles, each of said feed pipes having an orifice communicating with said means for creating a supply of steam, said steam entering said feed pipe through said orifice, said feed pipes also including a second orifice for providing said steam to said associated Coanda nozzle.

16. The apparatus for applying a flow of steam to a sheet of claim 15 wherein said means to provide steam further comprises:

a selectively actuable stepper motor;

means for adjustably controlling the percentage of said orifice which is open to said supply of steam, said orifice adjustable control means completely closing said orifice to prevent the flow of steam through one of said at least two Coanda nozzles and partially closing said orifice to adjust the volume of steam flowing through one of said at least two Coanda nozzles;

coupling means for connecting said stepper motor to said means for adjustably controlling said orifice.

17. A method of applying a flow of steam to a sheet for the purpose of heating the sheet, said method comprising the steps of creating a supply of steam and feeding said steam to a chamber leading to a Coanda nozzle;

running the sheet along a path adjacent one surface of an apparatus includng asid Coanda nozzle;

directing a flow of steam through said Coanda nozzle; said Coanda nozzle being arranged so that said flow of steam passing through said nozzle travels along a path parallel to said surface of said apparatus adjacent said sheet in a direction opposite the direction of travel of the sheet;

creating a secondary flow of steam and supplying said secondary flow to said sheet so that said secondary flow is entrained by said flow of steam from said Coanda nozzle.

18. The method of applying a flow of steam to a sheet of claim 17 further comprising the steps of:

providing a means for dividing said Coanda nozzle and said chamber leading into said nozzle into several Coanda nozzles and corresponding chambers;

selectively supplying steam through a selected one of said several chambers and corresponding Coanda nozzle.

* * * * *